US011365951B2

(12) United States Patent
Corsi et al.

(10) Patent No.: US 11,365,951 B2
(45) Date of Patent: Jun. 21, 2022

(54) DOUBLE-BARRELED REVOLVER

(71) Applicant: Connecticut Shotgun Manufacturing Company, New Britain, CT (US)

(72) Inventors: Paul Joseph Corsi, Terryville, CT (US); Antony Galazan, Avon, CT (US); Piotr G. Kumiega, New Britain, CT (US)

(73) Assignee: Connecticut Shotgun Manufacturing Company, New Britain, CT (US)

( * ) Notice: Subject to any disclaimer, the term of this patent is extended or adjusted under 35 U.S.C. 154(b) by 0 days.

(21) Appl. No.: 17/114,662

(22) Filed: Dec. 8, 2020

(65) Prior Publication Data

US 2021/0254925 A1 Aug. 19, 2021

Related U.S. Application Data

(63) Continuation of application No. 16/238,866, filed on Jan. 3, 2019, now Pat. No. 10,890,412.

(51) Int. Cl.

| | |
|---|---|
| ***F41C 3/14*** | (2006.01) |
| ***F41A 19/10*** | (2006.01) |
| ***F41A 21/06*** | (2006.01) |

(52) U.S. Cl.

CPC ..... *F41C 3/14* (2013.01); *F41A 19/10* (2013.01); *F41A 21/06* (2013.01)

(58) Field of Classification Search

CPC .. F41C 3/14; F41A 19/00; F41A 19/10; F41A 21/06

See application file for complete search history.

(56) References Cited

U.S. PATENT DOCUMENTS

| | | | |
|---|---|---|---|
| 35,404 | A | 5/1862 | Vaughan |
| 361,100 | A | 4/1887 | Wesson |
| 627,966 | A | 4/1899 | Behr |
| 943,819 | A | 12/1909 | Du Bose |
| 982,152 | A | 1/1911 | Marble |
| 990,669 | A | 4/1911 | Rodehaver |
| 1,042,145 | A | 10/1912 | Rodehaver |
| 2,259,397 | A | 10/1941 | Smith |

(Continued)

OTHER PUBLICATIONS www.militaryfactory.com, "Lefaucheaux 20-Round Double-Barreled Revolver," https://www.militaryfactory.com/smallarms/detail.asp?smallarms_id=315, (c) 2003-2018, Accessed Dec. 5, 2018.

(Continued)

*Primary Examiner* — J. Woodrow Eldred
(74) *Attorney, Agent, or Firm* — Ferdinand IP, LLC

(57) ABSTRACT

A firearm has a frame, a pivot connection connected to the frame, an elongated trigger lever coupled to the pivot connection and movable in a first direction between a rest position and an actuated position, the trigger lever including a first portion and a second portion, the first and second portions of the trigger lever being configured to receive first and second fingers of a user, and a trigger biasing structure including one or more bias springs to apply a force to the trigger lever to bias the trigger lever in a second direction opposite the first direction, and wherein a force applied to move the trigger lever in the first direction is the sum of an applied force multiplied by the distance between the first portion and the pivot connection and the applied force multiplied by the distance between the second portion and the pivot connection.

10 Claims, 9 Drawing Sheets

(56) References Cited

U.S. PATENT DOCUMENTS

| | | | |
|---|---|---|---|
| 3,093,922 | A | 6/1963 | Ivy |
| 3,173,221 | A | 3/1965 | Ivy |
| 4,041,633 | A | 8/1977 | Scrufari |
| 4,357,774 | A | 11/1982 | Badger |
| 7,861,449 | B1 | 1/2011 | Zajk |
| 8,096,079 | B2 | 1/2012 | Zajk |
| 8,359,777 | B2 | 1/2013 | Zajk |
| 8,887,429 | B2 | 11/2014 | Zajk |
| 2005/0183317 | A1 | 8/2005 | Finn |
| 2013/0192116 | A1 | 8/2013 | Elftmann |
| 2015/0292828 | A1 | 10/2015 | Nebeker et al. |

OTHER PUBLICATIONS

Wikimedia Foundation, Inc., "Henrion, Dassy & Heuschen double-barrel revolvers," https://en.wikipedia.org/wiki/Henrion,_Dassy_%26_Heuschen_double-barrel_revolvers, Last edited Oct. 15, 2017, Accessed Dec. 5, 2018.

Brian Dodson, "The triple barrel, 18-shot Pistola con Caricato revolver," https://newatlas.com/triple-barrel-revolver-surfaces/22523/, Published May 14, 2012, Accessed Dec. 5, 2018.

DOUBLE-BARRELED REVOLVER

CROSS-REFERENCE TO RELATED APPLICATIONS

This application claims priority under 35 U.S.C. § 120 from U.S. patent application Ser. No. 16/238,866, filed on Jan. 3, 2019 in the United States Patent and Trademark Office, the disclosure of which is incorporated herein in its entirety by reference.

FIELD OF THE INVENTION

The present invention relates to firearms, and more particularly to a double-barreled revolver that utilizes the trigger lever and a separate guard element to collectively define a protected trigger space.

BACKGROUND OF THE INVENTION

A revolver is a handgun having a revolving cylinder that includes multiple chambers and at least one barrel. Revolvers enable a shooter to fire multiple shots without reloading. Once a round is discharged, rearward movement of the trigger cocks the hammer and rotates the cylinder to align the next chamber with the barrel.

Revolvers having multiple barrels are well known. The Lefaucheux 20-Round is a double-barreled revolver with the barrels arranged vertically. The cylinder holds 20 rounds with two rows of ammunition. The inner chambers are spaced closer together than the outer chambers. The revolver features an oversized hammer that could discharge either barrel, but had the disadvantage of only discharging one chamber at a time per trigger pull. The Lefaucheaux 20-Round omits a conventional trigger guard. The Henrion, Dassy & Heuschen double-barrel revolver employed the same arrangement of chambers and barrels, and suffered from the same disadvantage of firing only one shot at a time. The Henrion, Dassy & Heuschen double-barrel revolver has a conventional trigger guard.

U.S. Pat. No. 3,173,221 to Ivy discloses a two-barrel revolver cylinder with different chamberings in a single cylinder. The barrels are arranged on radial concentric arcs. Ivy '221 teaches, " . . . it [the firing pin striking block 26 mounted on the striking face of the hammer head 25H] may be adjusted to an intermediate position for striking both pins simultaneously to fire cartridges of different calibers." However, Ivy '221 has the disadvantages of requiring the shooter to keep cartridges of different calibers and to perform an adjustment to the firing pin striking block in order to discharge two shots responsive to a single trigger pull. Ivy '221 has a conventional trigger guard.

Therefore, a need exists for a new and improved double-barreled revolver that utilizes the trigger lever and a separate guard element to collectively define a protected trigger space. In this regard, the various embodiments of the present invention substantially fulfill at least some of these needs. In this respect, the double-barreled revolver according to the present invention substantially departs from the conventional concepts and designs of the prior art, and in doing so provides an apparatus primarily developed for the purpose of utilizing the trigger lever and a separate guard element to collectively define a protected trigger space.

SUMMARY OF THE INVENTION

The present invention provides an improved double-barreled revolver, and overcomes the above-mentioned disadvantages and drawbacks of the prior art. As such, the general purpose of the present invention, which will be described subsequently in greater detail, is to provide an improved double-barreled revolver that has all the advantages of the prior art mentioned above. The foregoing and/or other features and utilities of the present general inventive concept may be achieved by providing a firearm including a frame, a pivot connection connected to the frame, an elongated trigger lever coupled to the pivot connection and movable in a first direction between a rest position and an actuated position, the trigger lever including a first portion proximate to the pivot connection, and a second portion adjacent to the first portion and distal from the pivot connection, the first and second portions of the trigger lever being configured to receive first and second fingers of a user, and a trigger biasing structure including one or more bias springs to apply a force to the trigger lever to bias the trigger lever in a second direction opposite the first direction. A force applied to move the trigger lever in the first direction may be the sum of an applied force multiplied by the distance between the first portion and the pivot connection and the applied force multiplied by the distance between the second portion and the pivot connection.

In an exemplary embodiment, the firearm may further include a safety trigger tab disposed on the trigger lever, the safety trigger tab being movable between a forward position and a rearward position. When the safety trigger tab is in the forward position the trigger lever may be prevented from moving to the actuated position.

In an exemplary embodiment, the safety trigger tab may be disposed in the first portion of the trigger lever.

In an exemplary embodiment, the firearm may further include one or more main springs, and a hammer. Moving the trigger lever in the first direction may cock the hammer. The one or more main springs may be configured to push the hammer in an operational direction when the trigger lever reaches the actuated position.

In an exemplary embodiment, the force applied to move the trigger lever in the first direction may compress the one or more main springs.

In an exemplary embodiment, the hammer may be configured to simultaneously discharge two cartridges when the hammer is pushed in the operational direction.

In an exemplary embodiment, the one or more main springs may include two main springs positioned on opposite sides of the hammer.

The foregoing and/or other features and utilities of the present general inventive concept may also be achieved by providing a firearm including a frame, a pivot connection connected to the frame, an elongated trigger lever coupled to the pivot connection and movable in a first direction between a rest position and an actuated position, the trigger lever including a first region configured to receive an applied force to operate the firearm, the first region being disposed a predetermined distance from the pivot connection, and a trigger biasing structure including one or more bias springs to apply a force to the trigger lever in a second direction opposite the first direction. A force applied to the trigger lever may be multiplied by the predetermined distance between the pivot connection and the first region, and said applied force may be greater than a force applied to the trigger lever at a second region proximate the pivot connection.

The foregoing and/or other features and utilities of the present general inventive concept may also be achieved by providing a firearm including a frame, a pivot connection connected to the frame, a spring, and an elongated trigger lever coupled to the pivot connection movable in a first direction between a rest position and an actuated position, the trigger lever being biased by the spring in a second direction opposite the first direction, the elongated trigger lever comprising a first portion proximate to the pivot connection and a second portion adjacent to the first portion and distal from the pivot connection wherein the first and second portions of the trigger lever are configured to receive first and second fingers of a user.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
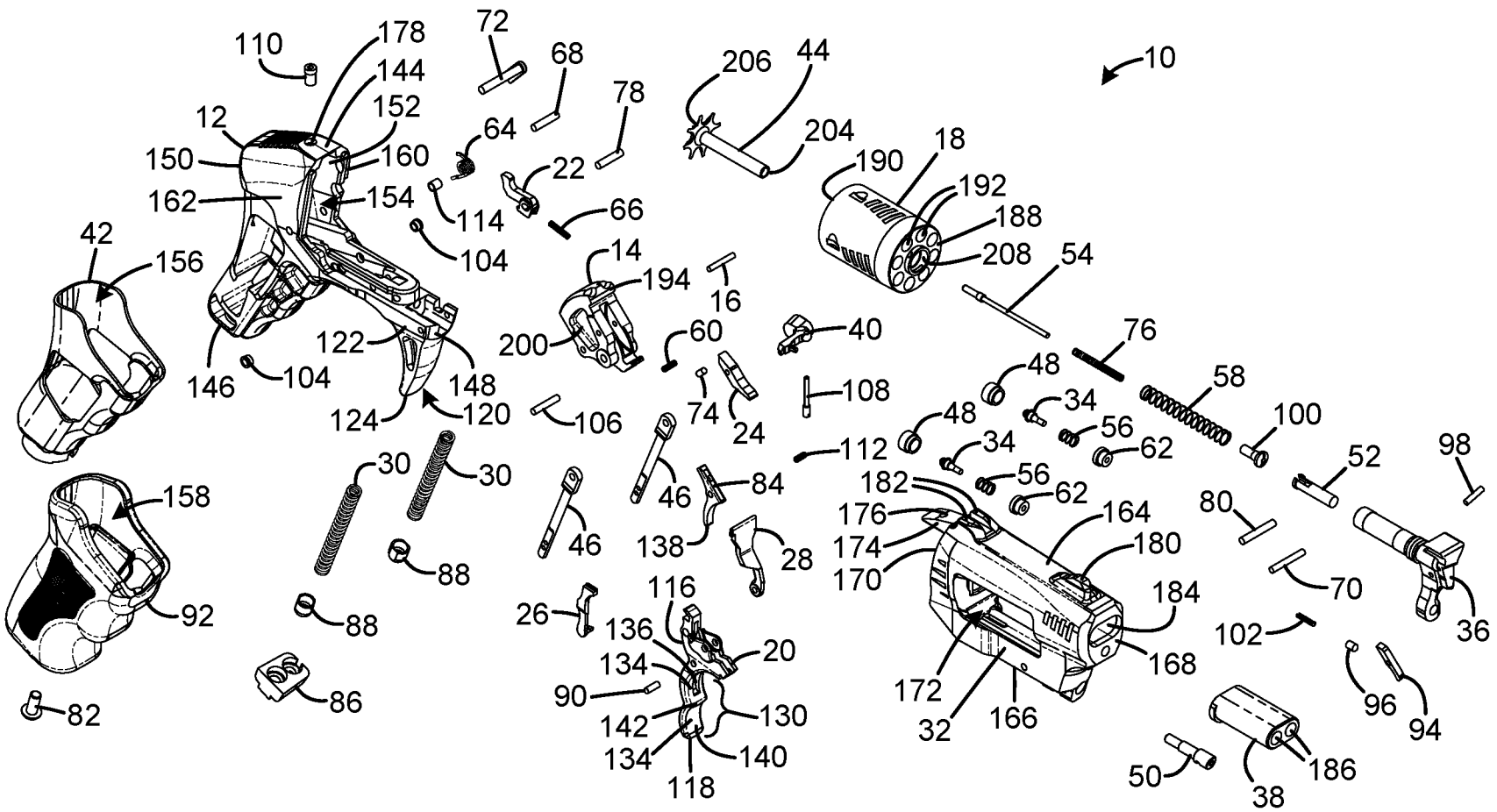
FIG. 1 is an exploded view of the current embodiment of the double-barreled revolver constructed in accordance with the principles of the present invention.

An embodiment of the double-barreled revolver of the present invention is shown and generally designated by the reference numeral 10.

Figure 2:
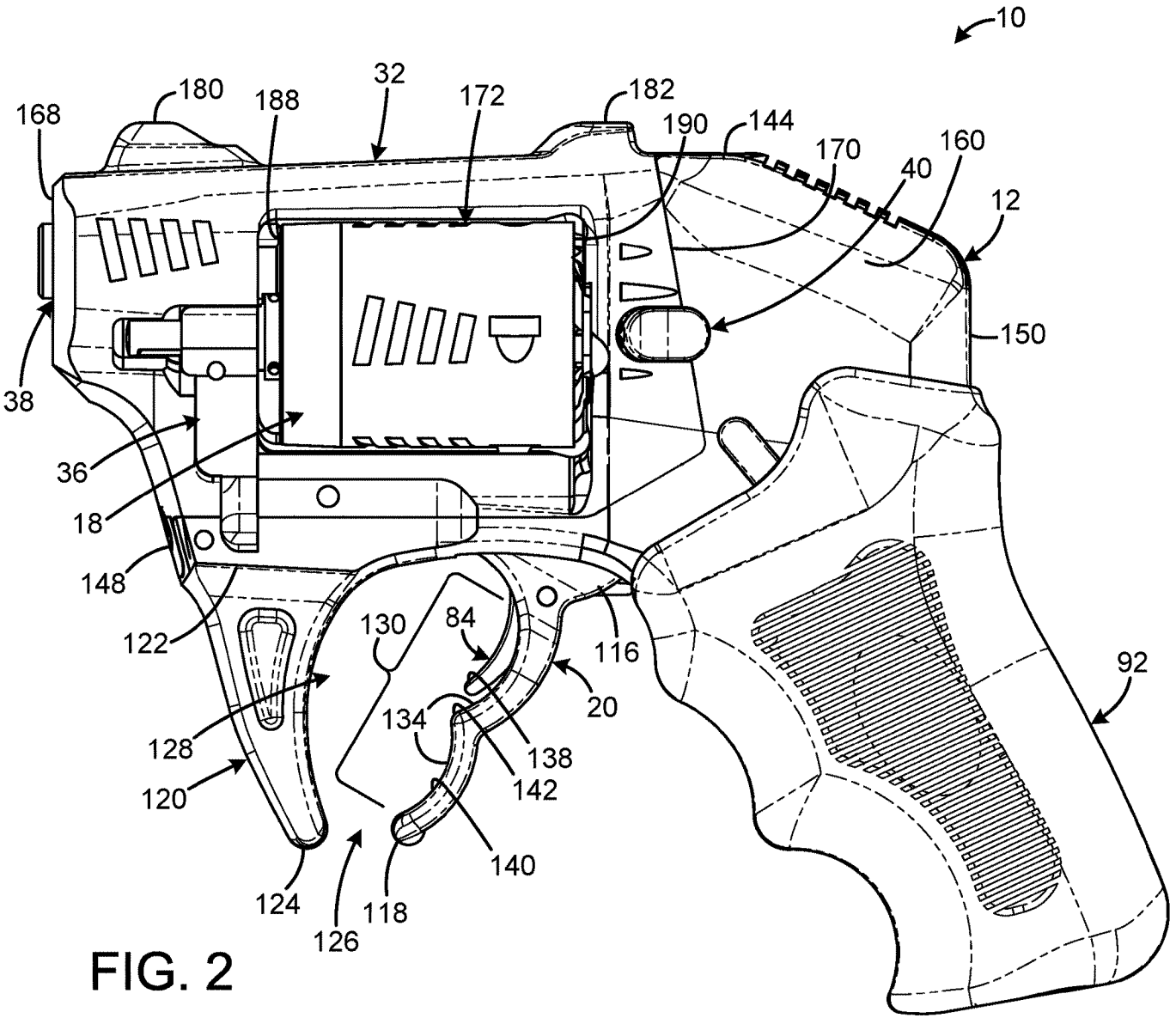
FIG. 2 is a left side view of the current embodiment of the double-barreled revolver of FIG. 1.

FIGS. 1 & 2 illustrate the improved double-barreled revolver 10 of the present invention. More particularly, the double-barreled revolver has a frame/hammer housing 12, a hammer subassembly 14, a hammer strut pin 16, a cylinder 18, a trigger lever 20, a cylinder latch bolt 22, a hammer strut 24, a rotation hand 26, a firing block blade 28, two main springs 30, a barrel body 32, two firing pins 34, a cylinder arm 36, a front port insert 38, a cylinder release 40, a grip cup 42, a cylinder ejector 44, two main spring guide rods 46, two firing pin cups 48, a cylinder arm pivot post 50, an ejector spring bushing 52, a cylinder pivot pin 54, two firing pin springs 56, an ejector spring 58, a hammer strut spring 60, two firing pin bushings 62, a trigger return hand spring 64, a bolt spring 66, a trigger pivot pin 68, a front frame pin 70, a hammer pivot pin 72, a strut plunger 74, a cylinder pivot spring 76, a cylinder bolt pin 78, a middle frame pin 80, a button head cap screw 82, a safety trigger tab 84, a main spring plate 86, two main spring cups 88, a trigger safe pin 90, an elastomer grip 92, a crane lock bolt 94, a crane lock plunger 96, a crane lock pin 98, an ejector spring screw tube 100, a crane bolt spring 102, two trigger bushings 104, a main spring hammer pin 106, a cylinder release pin 108, a barrel retaining screw 110, a trigger safety spring 112, and a trigger spring bushing 114.

Figure 4:
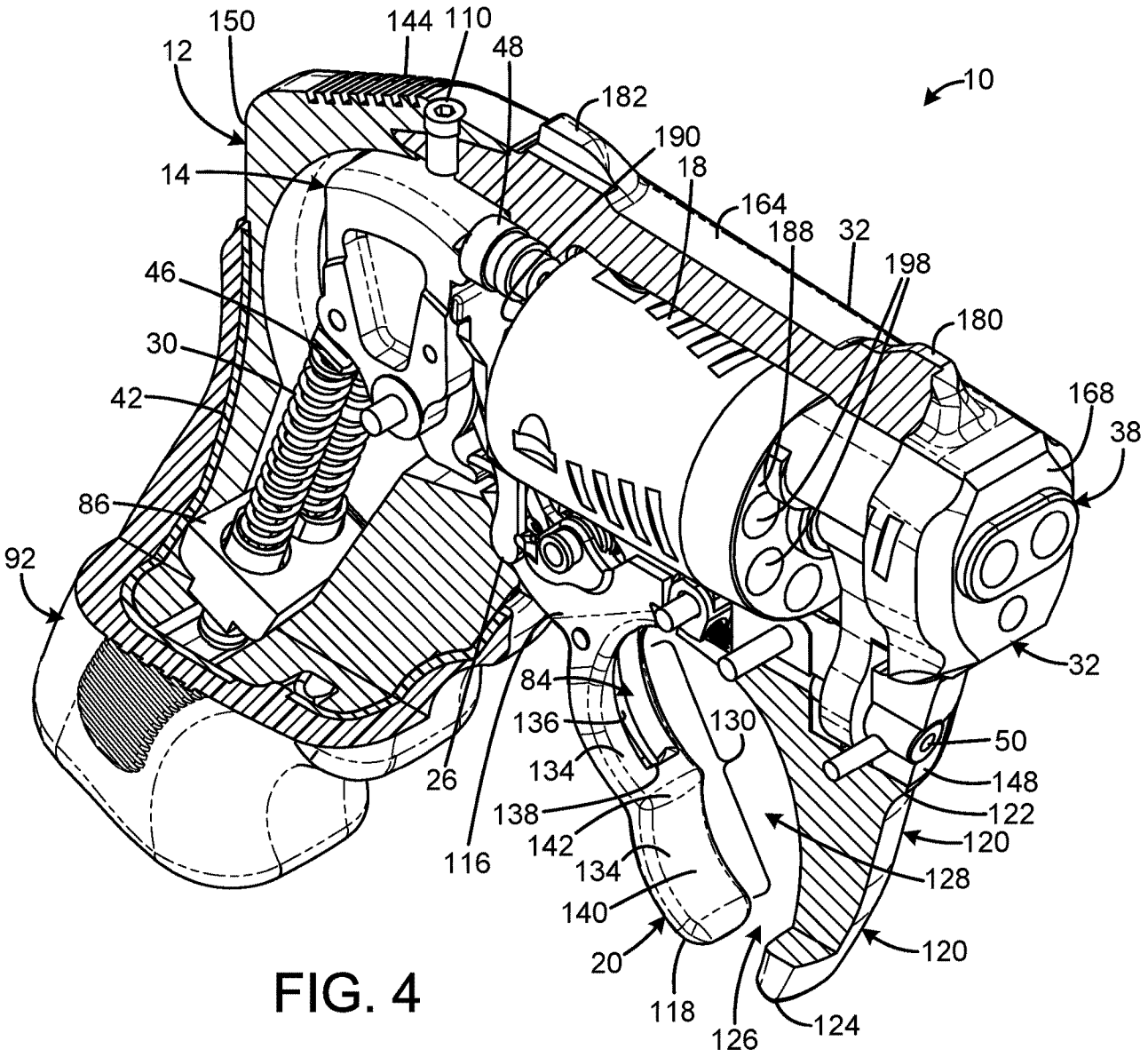
FIG. 4 is a right isometric cutaway view of the current embodiment of the double-barreled revolver of FIG. 1 with the trigger lever in the forward rest position.
Figure 5:
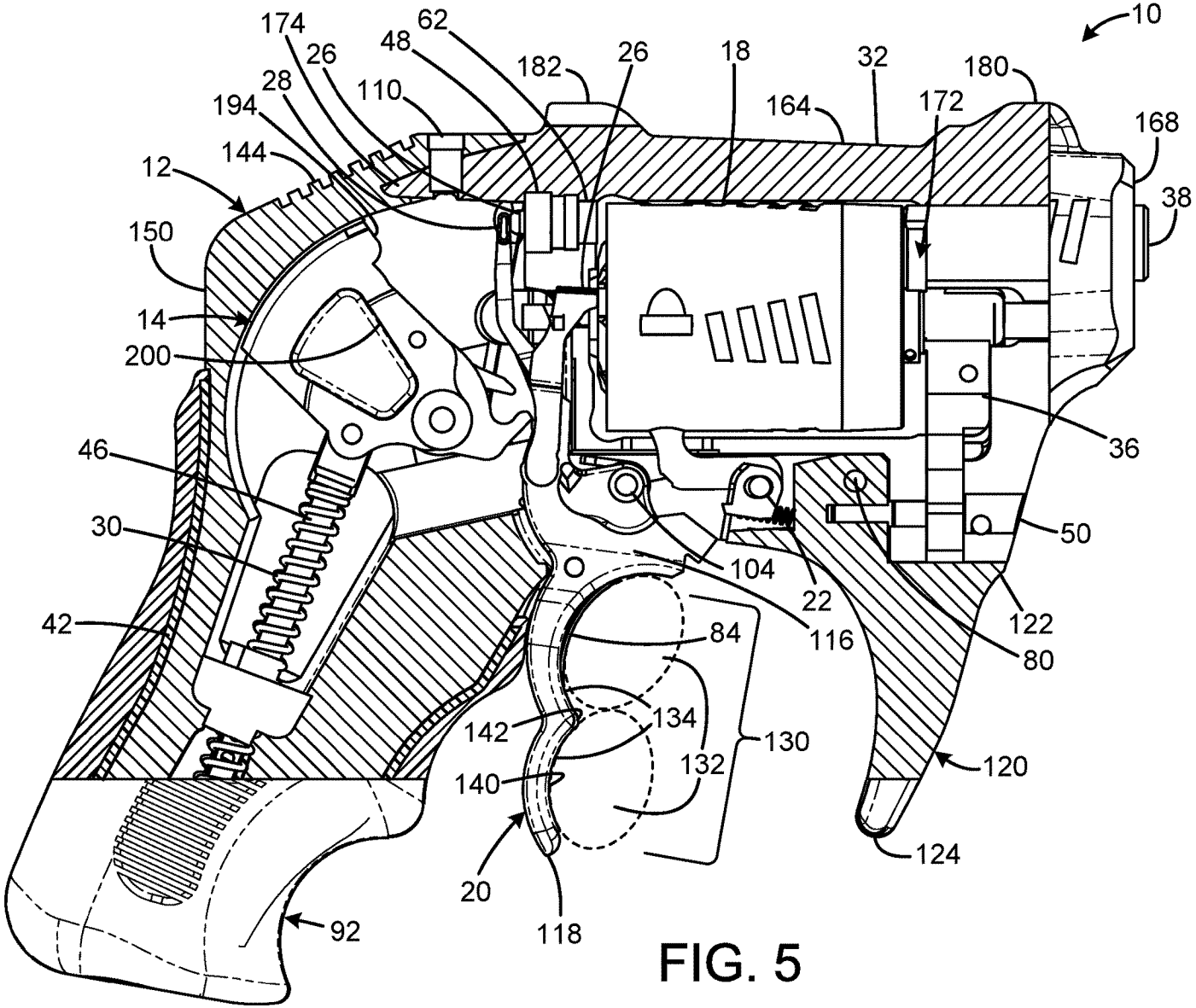
FIG. 5 is a right side cutaway view of the current embodiment of the double-barreled revolver of FIG. 1 with the trigger lever in the rearward actuated position.
Figure 6:
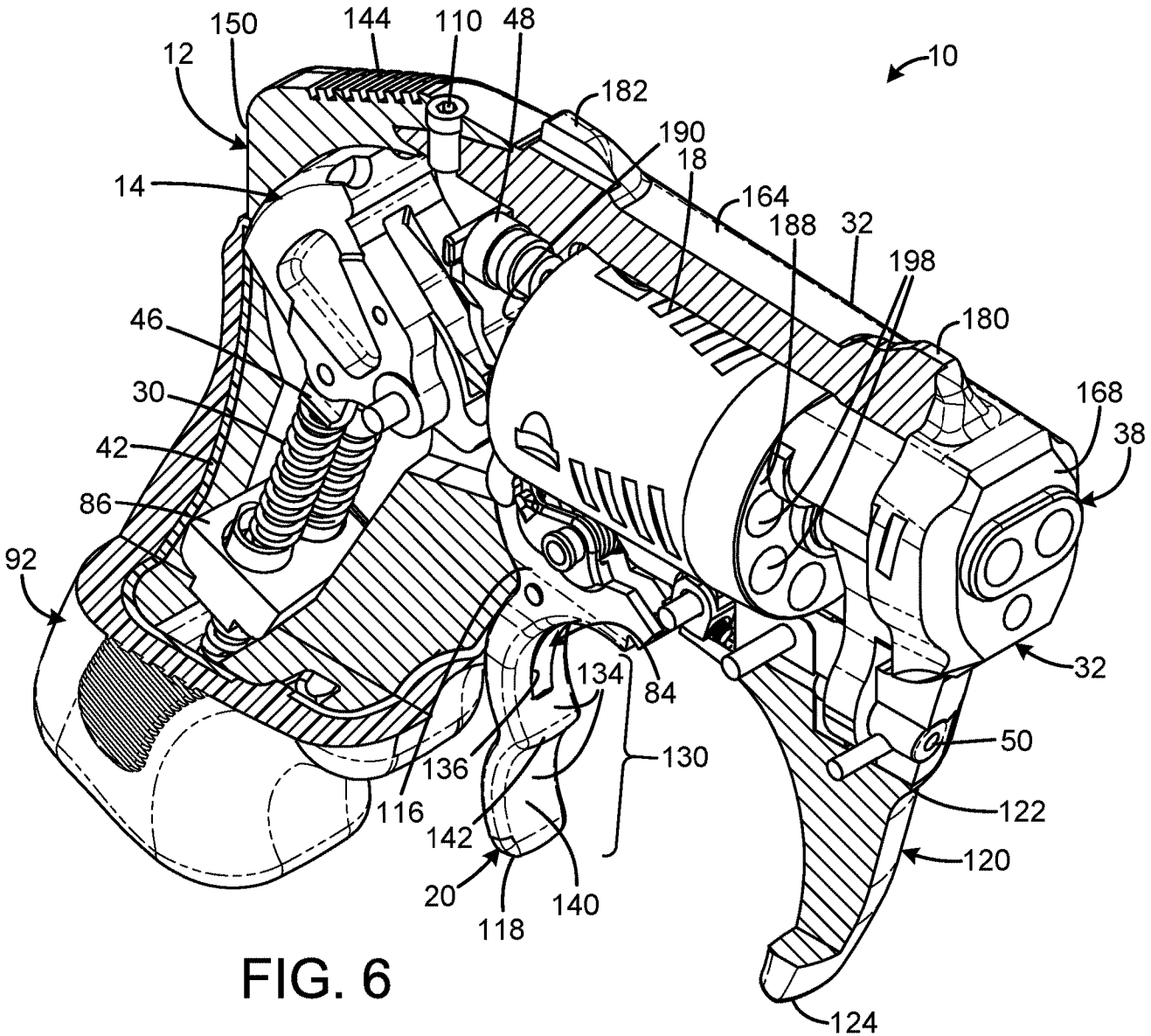
FIG. 6 is a right isometric cutaway view of the current embodiment of the double-barreled revolver of FIG. 1 with the trigger lever in the rearward actuated position.
Figure 7:
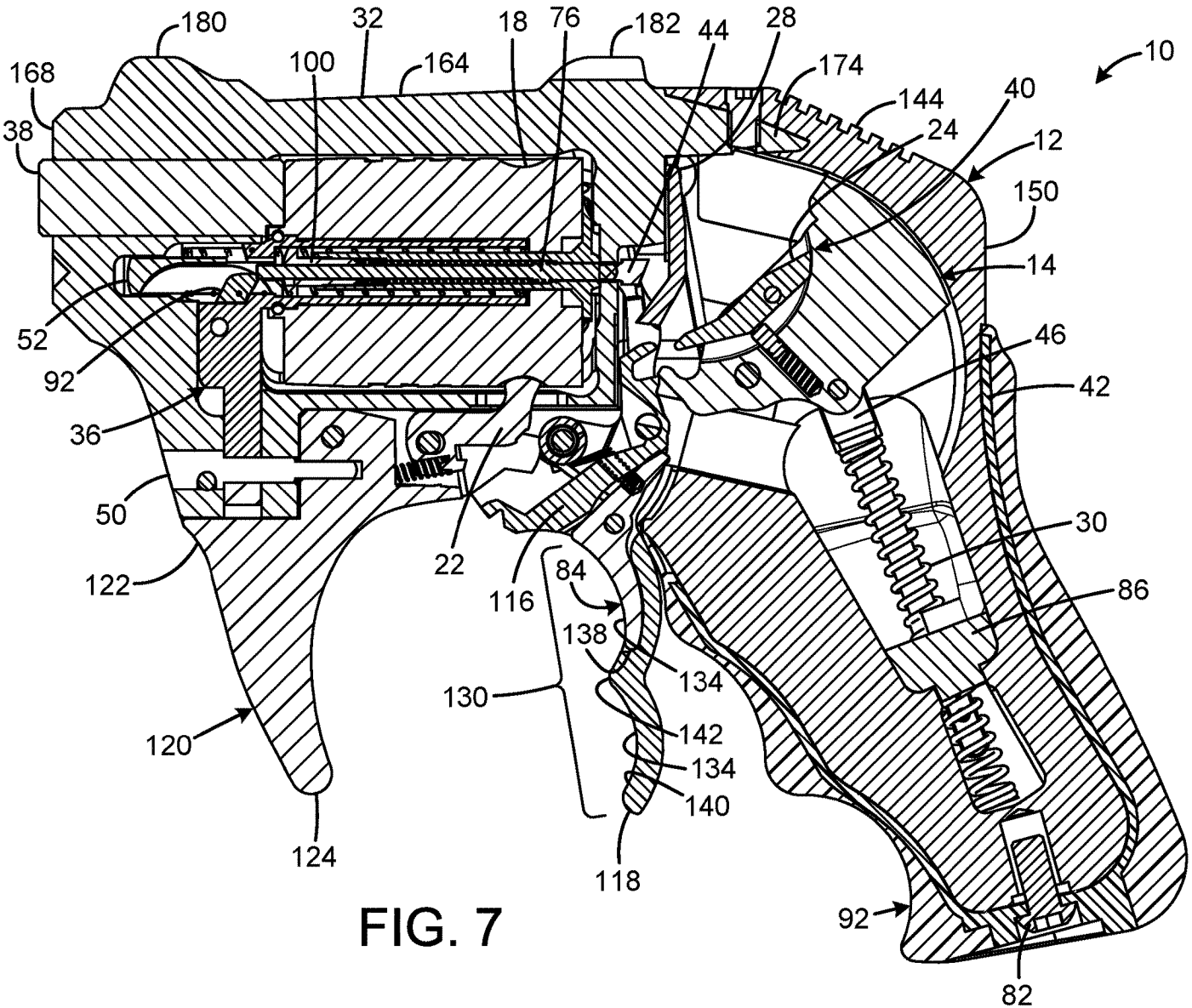
FIG. 7 is a left side sectional view of the current embodiment of the double-barreled revolver of FIG. 1 with the trigger lever in the rearward actuated position.

The trigger lever 20 has a first end 116 pivotally pinned to the hammer housing 12 and is movable between a forward rest position (shown in FIGS. 2-4) and a rearward actuated position (shown in FIGS. 5-7). The trigger lever has a free end 118 extending away from the frame that is opposite the first end. The hammer housing includes a guard element 120 located forward of the trigger lever having an upper end 122 connected to the frame and a downwardly depending lower end 124. The free end of the trigger lever is separated from the lower end of the guard element by a limited gap 126 such that the hammer housing, trigger lever, and guard element collectively define a protected trigger space 128. In the current embodiment, the limited gap is less than 0.9 cm such that a user's finger may not enter the protected trigger space except from a lateral direction. In the current embodiment, the limited gap is less than 0.9 cm to ensure against entry into the protected trigger space via the limited gap by an implement of limited width.

The trigger lever 20 has an exposed actuation portion 130 on a forward face 140 configured to be actuated by one or two fingers 132 (denoted by the dashed circles in FIG. 5). In the current embodiment, the exposed actuation portion includes adjacent concave finger contours 134 and the total actuation portion is greater than 3.6 cm long.

The exposed actuation portion 130 of the trigger lever 20 defines a vertical slot 136 in the uppermost of the adjacent concave finger contours 134. The trigger lever 20 is connected to the trigger safety/firing block blade 28. The trigger safety lever/safety trigger tab 84 has a lower end 138 that protrudes forward through the vertical slot when the trigger lever is in the forward at rest position (shown in FIGS. 2-4) and is received within the vertical slot when the trigger lever is initially actuated (shown in FIGS. 5-7). The safety trigger tab is movable between a forward safe position in which trigger action of the double-barreled revolver 10 is disabled (shown in FIGS. 2-4) and a rearward actuated position in which operation of the trigger lever of the double-barreled revolver 10 is enabled (shown in FIGS. 5-7). The safety trigger tab is limited to an upper portion of the trigger lever. In the current embodiment, the safety trigger tab is limited to the upper half of the exposed actuation portion 130 of the trigger lever within the uppermost of the adjacent concave finger contours. The adjacent concave finger contours provide the possibility of two finger rest positions, and the safety trigger tab is positioned at the upper finger rest position and away from the lower finger rest position. The two finger rest positions are separated by a dividing element 142, and the safety trigger tab is positioned above the dividing element. The lower end of the safety trigger tab is positioned at least 2.0 cm from the free end 118 of the trigger lever in the current embodiment. Thus, if the trigger lever is pulled from just the lower finger rest position, the trigger lever will not actuate, and the double-barreled pistol 10 will not discharge.

The hammer housing 12 has a top 144, bottom 146, front 148, rear 150, and a hollow interior 152. The top rear of the hammer housing defines an enclosed channel 154 that receives the hammer subassembly 14. The bottom rear of the hammer housing is received within the open top 156 of the grip cup 42 and the open top 158 of the elastomer grip 92. It should be appreciated that the grip cup and elastomer grip are molded as a composite part and are inseparable in the current embodiment. The seam between the grip cup/elastomer grip composite and the hammer housing forms a corner. The grip cup/elastomer grip composite is releasably secured to the bottom rear of the hammer housing by the button head cap screw 82, which is a #8-32 button head cap screw in the current embodiment. The bottom front of the hammer housing forms the guard element 120. The hammer housing also has a left side 160 and a right side 162.

The barrel body 32 has a top 164, bottom 166, front 168, rear 170, and defines a cavity 172. The top rear of the barrel body includes a rear boss 174 defining an aperture 176. When the rear boss is inserted into the hollow interior 152 of the hammer housing 12, aperture 176 is registered with an aperture 178 in the top rear of the hammer housing such that barrel retaining screw 110 can releasably secure the barrel body to the hammer housing. The top of the barrel body includes a front sight 180 and a rear sight 182. The front of the barrel body defines an aperture 184 that receives the front port insert 38. The front port insert defines two rifled barrel bores 186.

The cartridge cylinder 18 has a front 188 and a rear 190. The cartridge cylinder is rotatably mounted on the cylinder arm 36 and cylinder pivot pin 54 within the cavity 172 defined by the barrel body. The cartridge cylinder defines four pairs of chambers 192 for a total of eight chambers. Each chamber pair is separated by a quarter-turn of the cartridge cylinder (90°) and is sequentially registered with the barrels 186 as the trigger lever 20 is cycled to discharge the double-barreled revolver 10 and re-cock the hammer 14.

The hammer subassembly 14 is pivotally connected to the hammer housing 12 to pivot within the enclosed channel 154 in the top rear of the hammer housing. The hammer subassembly interfaces with the first end 116 of the trigger lever 20. The hammer subassembly has a single forward striking face 194 that is positioned to strike the blocker blade 28 that actuates two firing pins 34 that are positioned to discharge rimfire cartridges. A pair of hammer spring/main springs 30 are operatively connected to the hammer subassembly to bias the striking face of the hammer subassembly toward the rear 190 of the cartridge cylinder 18. The hammer subassembly swings within the enclosed channel with a very small gap between the hammer subassembly and the hammer housing to minimize the overall size of the double-barreled pistol 10. The enclosed channel is an arcuate passage centered on the hammer subassembly pivot point 198.

The cylinder ejector 44 has a front 204 and a rear 206. The front of the extractor is inserted through the rear of an ejector bore 208 in the center of the cartridge cylinder and receives the ejector spring 58. The rear of the extractor is star-shaped, with gaps 208 that are axially registered with the four pairs of chambers 192. The user pushes the cylinder ejector rearward to extract unfired or discharged cartridges from the four pairs of chambers.

Figure 3:
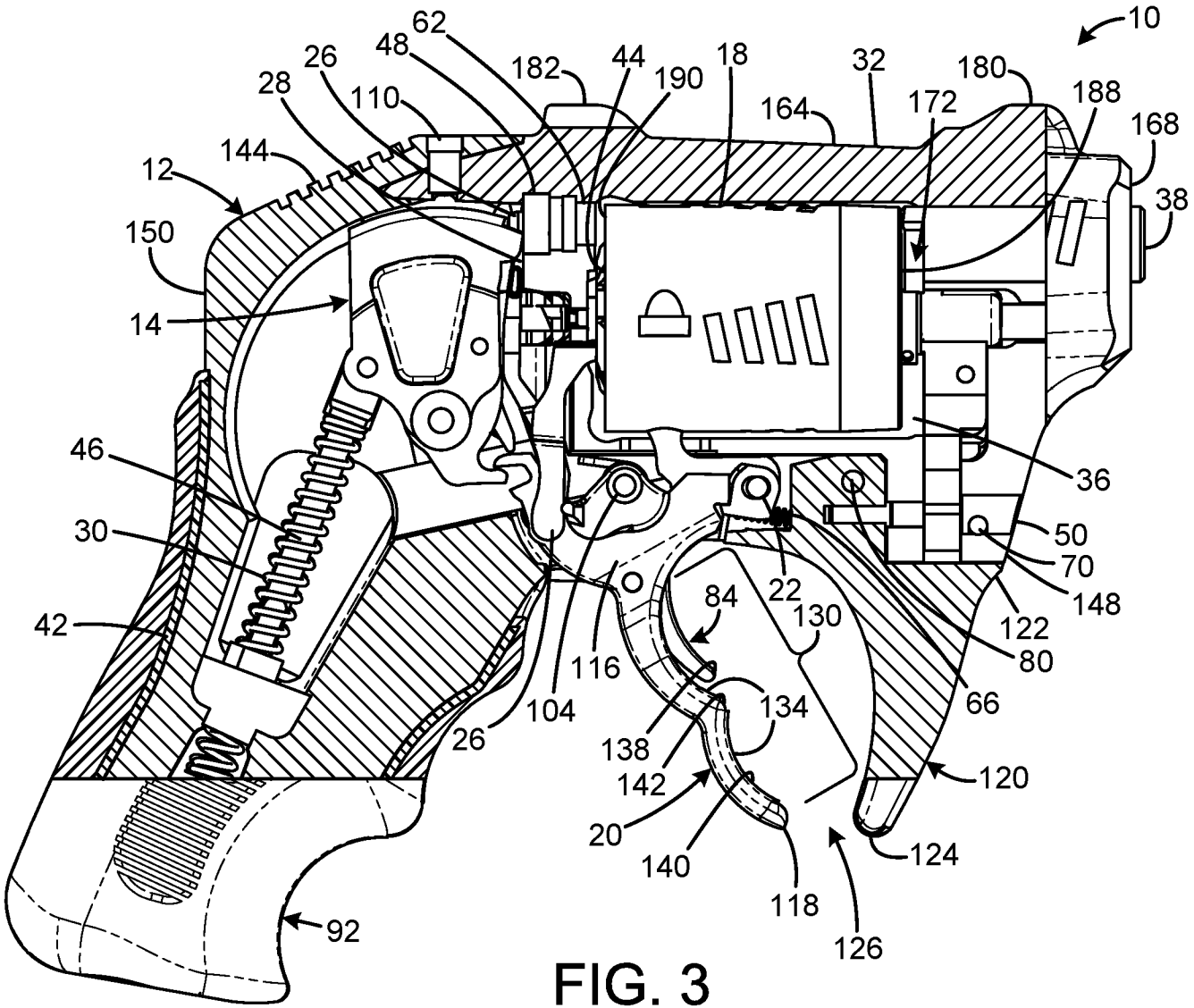
FIG. 3 is a right side cutaway view of the current embodiment of the double-barreled revolver of FIG. 1 with the trigger lever in the forward rest position.

FIGS. 3 & 4 illustrate the improved double-barreled revolver 10 of the present invention. More particularly, the double-barreled revolver is shown with the trigger lever 20 in the forward rest position and the hammer subassembly 14 uncocked, which is the default condition when the double-barreled revolver 10 is not in use. When the trigger lever is in the forward rest position, the combination of the trigger lever and the guard element 120 effectively constitutes a self-forming trigger guard to protect against accidental discharge of the double-barreled revolver 10. When the trigger lever is in the forward rest position, the lower end 138 of the safety trigger tab 84 protrudes forward through the vertical slot 136 in the trigger lever. When the safety trigger tab is in this position the trigger lever cannot be actuated. The firing block blade 28 is positioned by the trigger lever's action to transfer hammer striking force to the firing pins 34. If the trigger lever is not in the rear position, the hammer subassembly 14 face cutouts will not engage the firing pins 34. So, if the trigger lever is released before a full stroke has occurred, the hammer striking force is not transferred to the firing pins, and ignition is disabled.

Figure 8:
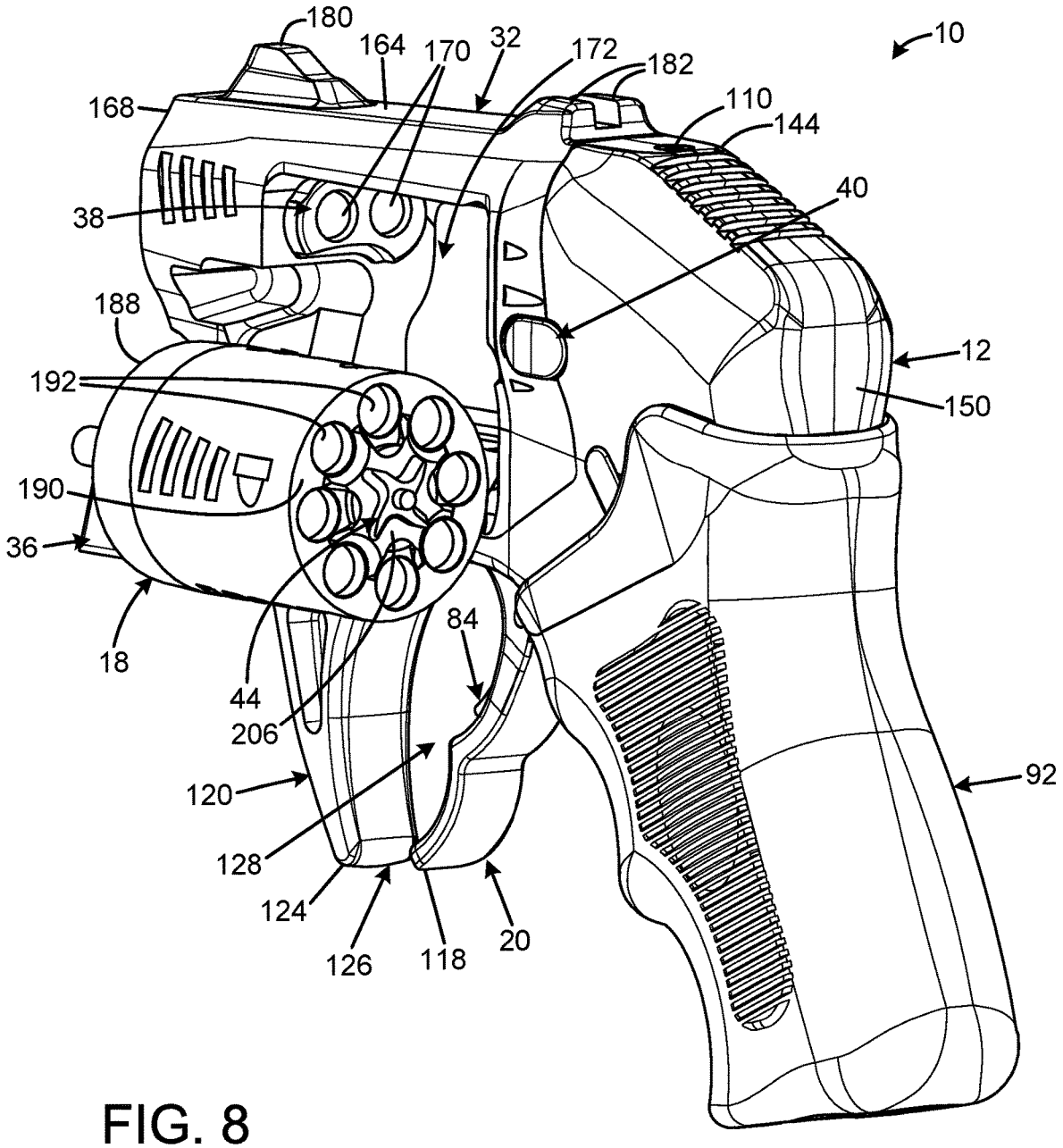
FIG. 8 is a left isometric view of the current embodiment of the double-barreled revolver of FIG. 1 with the trigger lever in the forward rest position and the cartridge cylinder in the opened position.

FIGS. 5-7 illustrate the improved double-barreled revolver 10 of the present invention. More particularly, the double-barreled revolver is shown with the trigger lever 20 having been pulled rearward relative to the position shown in FIGS. 3 & 4 to discharge the double-barreled revolver 10. First, the shooter grips the adjacent concave finger contours 134 on the trigger lever 20. Second, the shooter depresses the lower end 138 of the safety trigger tab 84 into the vertical slot 136. As the lower end of the safety trigger tab is depressed into the vertical slot, the trigger safety spring 112 is compressed, enabling the trigger lever to actuate. The firing block blade 28 connected to the trigger lever near the first end 116 is raised by trigger rotation to be shifted in between the forward striking face 194 of the hammer subassembly 14 and the firing pins 34. Once the trigger lever is no longer obstructed by the safety trigger tab, the shooter uses one or both fingers to pull the trigger lever rearward to the position shown in FIGS. 5-7. As the trigger lever moves rearward between the position shown in FIGS. 3 & 4 and the position shown in FIGS. 5-7, the hammer subassembly is cocked rearward within the enclosed channel 154. The rearward movement of the trigger lever compresses the trigger return hand spring 64 and the two main springs 30. Once the trigger lever reaches the position shown in FIGS. 5-7, the hammer subassembly is released to fly forward under the influence of the two main springs within the enclosed channel 154 until the forward striking face of the hammer strikes the blocker blade 28, thereby transferring the force to two firing pin cups 48. The force exerted by the hammer upon the firing pin cups drives the two firing pins forward, compressing the two firing pin springs 64 and causing the forward ends of the firing pins to simultaneously discharge two rimfire cartridges held within two chambers of a pair of chambers 192 that are registered with the firing pins and the barrels 186. After the two rimfire cartridges have discharged and the trigger lever is returned to forward position, the two firing pin springs return the two firing pins to their rest positions, with the hammer subassembly remaining in an uncocked state against the rear face 170 of the barrel body 32 with the cutouts on the forward striking face surrounding the firing pins (the forward striking face cannot contact the firing pins directly because of the cutouts). The trigger return hand spring 64 acts to return the trigger lever to the forward rest position once the shooter stops pulling the trigger lever. The rotation hand 26 rotates the cartridge cylinder 90° under the influence of the trigger return hand spring to register a new pair of chambers with the firing pins and the barrels. The rotation hand 26 and its length and slot location are specifically arranged to engage and rotate features on the ejector 44 hub end 206 (shown most clearly in FIG. 8) 90° with each trigger lever pull.

The shooter then has three options. The shooter can leave the double-barreled pistol 10 at rest in the safe condition with the trigger lever 20 in the forward rest condition. The user can pull the trigger lever again to simultaneously discharge the two rimfire cartridges in the new pair of chambers 192 that are registered with the two firing pins 34 and the two barrels 186. Or, the user can pivot the cartridge cylinder 18 out of the cavity 172 (shown in FIG. 8) to operate the cylinder ejector 44 to eject the spent or unfired rimfire cartridges from the pairs of chambers, reload or empty the pairs of chambers with new rimfire cartridges, and return the cartridge cylinder to the cavity.

Figure 9A:
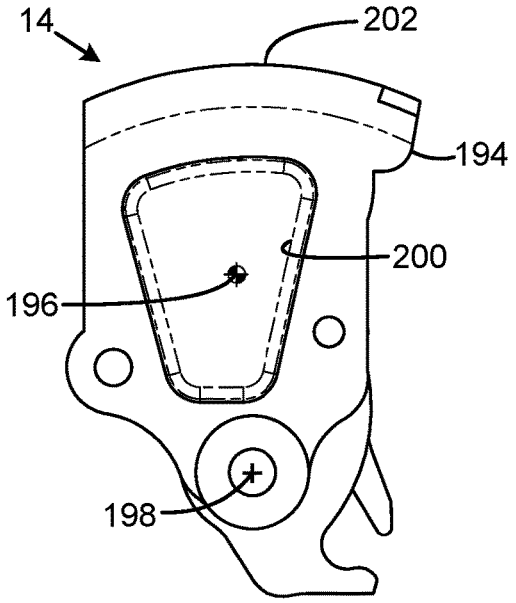
FIG. 9A is a right side view of the current embodiment of the hammer subassembly of FIG. 1.
Figure 9B:
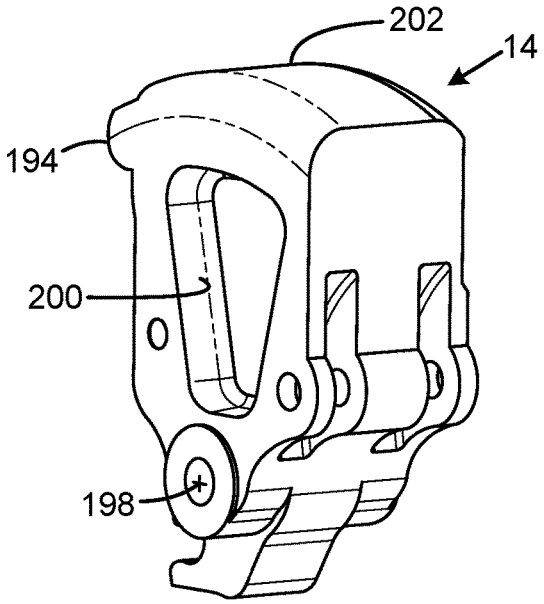
FIG. 9B is a rear isometric view of the current embodiment of the hammer subassembly of FIG. 1.
Figure 9C:
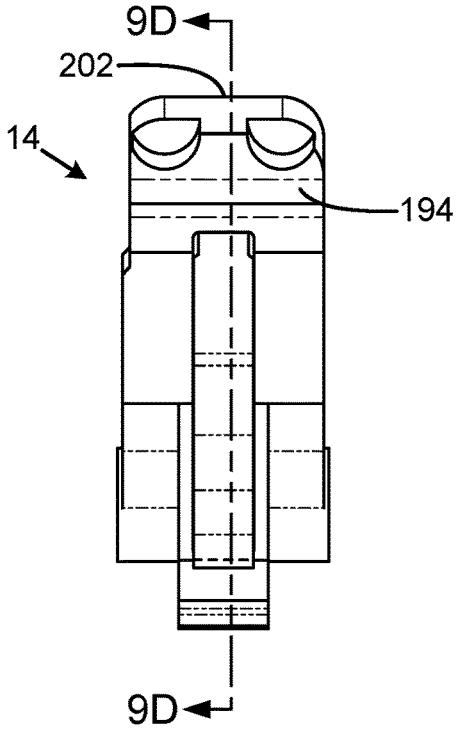
FIG. 9C is a front view of the current embodiment of the hammer subassembly of FIG. 1.
Figure 9D:
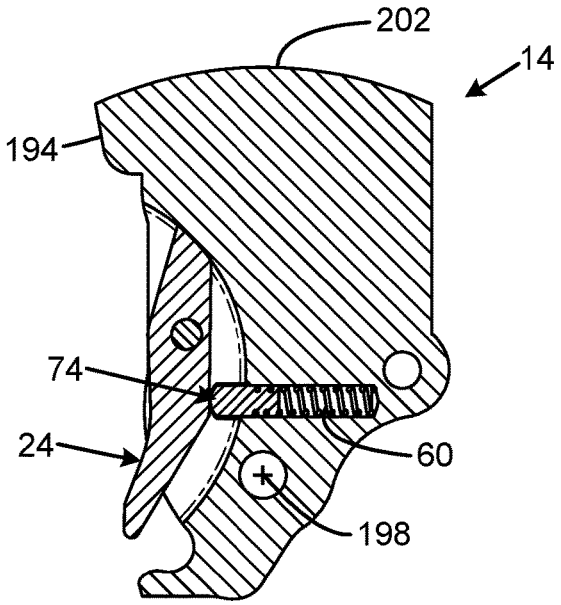
FIG. 9D is a side sectional view taken along line 9D-9D of FIG. 9C.

FIGS. 9A-9D illustrate the improved hammer subassembly 14 of the present invention. More particularly, the hammer subassembly is heavier and larger than a conventional hammer so the hammer subassembly can simultaneously discharge two rimfire cartridges held within two chambers of a pair of chambers 192 that are registered with the barrels 186. As is shown in FIG. 9A, the hammer subassembly has a center of mass 196 that is located 0.530 inch above and 0.040 inch behind pivot point 198. The hammer defines two recesses 200 (one on each side) below the forward striking face 194 to reduce the overall weight of the hammer subassembly and shift the center of mass upwards. The maximum height 202 of the hammer subassembly is 2.75 cm above the pivot point. Because rimfire cartridges are manufactured with significant variations in rim thicknesses, a more massive hammer subassembly driven by a pair of main springs 30 (one on each side of the hammer) is used to ensure the hammer subassembly has adequate mass and unilateral or unbiased power to discharge both rimfire cartridges simultaneously even if one cartridge has a thinner rim than the other. Thus, the double-barreled pistol 10 has an unusually heavy trigger pull of 11 lbs. because every time the trigger lever 20 is pulled, the trigger lever is compressing the two main springs during cocking, and the hammer subassembly needs to be atypically heavy and powerful. Thus, the trigger lever is longer than a conventional trigger to enable a user to utilize two fingers instead of one if needed to apply the necessary force to cock the hammer subassembly. The longer trigger lever of the current invention makes a conventional trigger guard impractical because of size considerations and the fact that the unusually heavy trigger pull will negate accidental trigger actuation.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a double-barreled revolver has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention or similar larger configurations for various calibers.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A firearm comprising:

a frame;

a pivot connection connected to the frame;

an elongated trigger lever coupled to the pivot connection and movable in a first direction between a rest position and an actuated position, the trigger lever comprising:

a first portion proximate to the pivot connection, and a second portion adjacent to the first portion and distal from the pivot connection, the first and second portions of the trigger lever being configured to receive first and second fingers of a user; and a trigger biasing structure including one or more bias springs to apply a force to the trigger lever to bias the trigger lever in a second direction opposite the first direction;

wherein a force applied to move the trigger lever in the first direction is the sum of an applied force multiplied by the distance between the first portion and the pivot connection and the applied force multiplied by the distance between the second portion and the pivot connection; and wherein the trigger lever defines a gap between a distal end of the trigger lever and the frame when the trigger lever is at the rest position, the gap being configured to prevent the user's finger from passing therethrough to access the first or second portions of the trigger lever.

2. The firearm of claim 1, further comprising a safety trigger tab disposed on the trigger lever, the safety trigger tab being movable between a forward position and a rearward position, wherein when the safety trigger tab is in the forward position the trigger lever is prevented from moving to the actuated position.

3. The firearm of claim 2, wherein the safety trigger tab is disposed in the first portion of the trigger lever.

4. The firearm of claim 1, further comprising:

one or more main springs; and a hammer, wherein moving the trigger lever in the first direction cocks the hammer, wherein the one or more main springs are configured to push the hammer in an operational direction when the trigger lever reaches the actuated position.

5. The firearm of claim 4, wherein the force applied to move the trigger lever in the first direction compresses the one or more main springs.

6. The firearm of claim 4, wherein the hammer is configured to simultaneously discharge two cartridges when the hammer is pushed in the operational direction.

7. The firearm of claim 4, wherein the one or more main springs comprise two main springs positioned on opposite sides of the hammer.

8. A firearm comprising:

a frame;

a pivot connection connected to the frame, an elongated trigger lever coupled to the pivot connection and movable in a first direction between a rest position and an actuated position, the trigger lever including a first region configured to receive an applied force to operate the firearm, the first region being disposed a predetermined distance from the pivot connection; and a trigger biasing structure including one or more bias springs to apply a force to the trigger lever in a second direction opposite the first direction;

wherein a force applied to the trigger lever to operate the firearm is multiplied by the predetermined distance between the pivot connection and the first region; and wherein the trigger lever defines a gap between a distal end of the trigger lever and the frame when the trigger lever is at the rest position, the gap being configured to prevent a user's finger from passing therethrough to access the first region of the trigger lever.

9. A firearm comprising:

a frame;

a pivot connection connected to the frame;

a spring; and an elongated trigger lever coupled to the pivot connection movable in a first direction between a rest position and an actuated position, the trigger lever being biased by the spring in a second direction opposite the first direction, the elongated trigger lever comprising a first portion proximate to the pivot connection and a second portion adjacent to the first portion and distal from the pivot connection wherein the first and second portions of the trigger lever are configured to receive first and second fingers of a user;

wherein the trigger lever defines a gap between a distal end of the trigger lever and the frame when the trigger lever is at the rest position, the gap being configured to prevent the user's finger from passing therethrough to access the first or second portions of the trigger lever.

10. The firearm of claim 4, wherein the hammer is configured to fire rimfire cartridges.

* * * * *